US011008746B2

(12) United States Patent
Ko et al.

(10) Patent No.: US 11,008,746 B2
(45) Date of Patent: May 18, 2021

(54) SANITARY WASHING DEVICE

(71) Applicant: TOTO LTD., Kitakyushu (JP)

(72) Inventors: Yuki Ko, Kitakyushu (JP); Masayuki Mochita, Kitakyushu (JP); Yoshihiro Koto, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 16/878,717

(22) Filed: May 20, 2020

(65) Prior Publication Data

US 2020/0392713 A1 Dec. 17, 2020

(30) Foreign Application Priority Data

Jun. 14, 2019 (JP) ..... JP2019-110879

(51) Int. Cl.
*E03D 9/08* (2006.01)
*B05B 15/70* (2018.01)

(52) U.S. Cl.
CPC ..... *E03D 9/08* (2013.01); *B05B 15/70* (2018.02)

(58) Field of Classification Search
CPC ..... E03D 9/08
USPC ..... 134/57 R; 4/443–445, 433, 447, 4/420.1–420.5, 538–660
See application file for complete search history.

(56) References Cited

U.S. PATENT DOCUMENTS 2,627,074 A * 2/1953 Karp ..... A61M 3/0266 604/92
3,528,112 A * 9/1970 Warnick ..... E03D 9/085 4/568
5,826,282 A * 10/1998 Matsumoto ..... E03D 9/08 4/420.4
5,884,345 A * 3/1999 Sugiyama ..... E03D 9/08 4/420.4
5,898,956 A * 5/1999 Kurisaki ..... E03D 9/08 4/420.4

(Continued)

FOREIGN PATENT DOCUMENTS

EP 3263784 A1 1/2018
JP 2008-223244 A 9/2008

(Continued)

OTHER PUBLICATIONS

Decision to Grant for the corresponding Japanese Patent Application No. 2019-110879 dated Aug. 17, 2020.

*Primary Examiner* — Lori L Baker
(74) *Attorney, Agent, or Firm* — Pearne & Gordon LLP

(57) ABSTRACT

A sanitary washing device is on a toilet including a bowl. The sanitary washing device includes a casing, a nozzle, a shielding plate, and a controller. The nozzle washes a human body private part. The nozzle is advanceable and retractable between a storage position and an advanced position. The shielding plate is rotatable with respect to the casing and positioned frontward of the nozzle when the nozzle is at the storage position. The controller controls an operation of the nozzle. The nozzle has a first spout hole squirting water. The shielding plate is at a first position when the nozzle is at the advanced position. The controller performs a frontward washing operation of squirting water after using the sanitary washing device. A part of the shielding plate is positioned frontward of a front end part of the nozzle in the frontward washing operation.

9 Claims, 10 Drawing Sheets

(56) References Cited

U.S. PATENT DOCUMENTS 6,128,788 A * 10/2000 Yamazaki ..... A61G 7/0005 4/323
6,754,912 B1 * 6/2004 Hayashi ..... E03D 9/08 239/468
7,191,473 B2 * 3/2007 Matsumoto ..... E03D 9/08 4/420.2
7,287,286 B2 * 10/2007 Lee ..... E03D 9/08 4/420.4
8,060,953 B1 * 11/2011 Dorra ..... A47K 13/302 4/233
8,161,580 B2 * 4/2012 Hashidume ..... E03D 9/08 4/420.4
8,256,039 B2 * 9/2012 Morotomi ..... E03D 9/08 4/443
8,381,323 B2 * 2/2013 Mochita ..... B05B 1/3489 4/420.3
8,418,278 B2 * 4/2013 Mochita ..... B05B 1/083 4/433
8,495,770 B2 * 7/2013 Koga ..... B05B 15/74 4/420.4
8,505,126 B2 * 8/2013 Morotomi ..... E03D 9/08 4/443
8,667,621 B2 * 3/2014 Hashimoto ..... B05B 12/04 4/420.2
8,776,278 B1 * 7/2014 Dorra ..... A47K 13/302 4/233
8,904,574 B2 * 12/2014 Hashimoto ..... E03D 9/08 4/443
9,049,970 B2 * 6/2015 Dorra ..... A47K 13/302
9,074,361 B2 * 7/2015 Mochita ..... E03D 9/08
9,096,997 B2 * 8/2015 Mochita ..... E03D 9/08
10,125,482 B2 * 11/2018 Hashimoto ..... E03D 9/08
10,190,302 B2 * 1/2019 Hashimoto ..... E03D 9/08
10,233,626 B2 * 3/2019 Otowa ..... E03D 9/08
10,501,922 B2 * 12/2019 Yaoka ..... B05B 15/70
10,519,644 B2 * 12/2019 Schwab ..... B05B 15/656
10,526,774 B2 * 1/2020 Schwab ..... E03D 9/08
10,563,390 B2 * 2/2020 Schwab ..... B05B 15/62
2011/0030133 A1 * 2/2011 Morotomi ..... E03D 9/08 4/443
2011/0061160 A1 * 3/2011 Mochita ..... E03D 9/08 4/615
2011/0072570 A1 * 3/2011 Morotomi ..... E03D 9/08 4/420.2
2012/0144574 A1 * 6/2012 Morotomi ..... E03D 9/08 4/443
2017/0030066 A1 * 2/2017 Maeda ..... E03D 11/02
2017/0260732 A1 * 9/2017 Kashirajima ..... E03D 11/02
2018/0002912 A1 * 1/2018 Yaoka ..... B05B 1/16
2018/0058054 A1 * 3/2018 Yoshida ..... E03D 9/08
2018/0344110 A1 * 12/2018 Tsujita ..... E03D 5/105
2018/0344111 A1 * 12/2018 Tsuiki ..... E03D 9/08
2018/0347166 A1 * 12/2018 Tanogashira ..... E03D 9/08
2018/0347167 A1 * 12/2018 Tsujita ..... E03D 5/04
2018/0347169 A1 * 12/2018 Tsujita ..... G01S 13/04
2019/0169827 A1 * 6/2019 Morioka ..... E03D 5/10
2019/0169828 A1 * 6/2019 Morioka ..... E03D 9/08
2019/0169829 A1 * 6/2019 Morioka ..... E03D 9/08
2019/0368180 A1 * 12/2019 Yaoka ..... E03D 9/08
2019/0368181 A1 * 12/2019 Yaoka ..... A61L 2/186

FOREIGN PATENT DOCUMENTS

JP 2015-101941 6/2015
JP 2015-101942 A 6/2015
JP 2017-066636 4/2017

* cited by examiner

SANITARY WASHING DEVICE

CROSS-REFERENCE TO RELATED APPLICATIONS

This application is based upon and claims the benefit of priority from Japanese Patent Application No. 2019-110879, filed on Jun. 14, 2019; the entire contents of which are incorporated herein by reference.

FIELD

Embodiments described herein relate generally to a sanitary washing device.

BACKGROUND

The squirting of water or functional water into the bowl of a toilet after use is conventionally known as a technique for suppressing the adhesion and/or deposition of dirt on the bowl. As an example, there is a device such as that of JP-A 2015-101942 in which a spout hole that squirts water toward the bowl is provided in a human body private part-washing nozzle of the sanitary washing device, and water is squirted from the spout hole toward the bowl by advancing the nozzle from a casing.

However, in such a sanitary washing device, the nozzle is provided to be advanced frontward and downward from the casing positioned at the back side of the bowl. Therefore, if the spout hole squirts the water at a constant squirt angle, the vertical position of the spout hole is low when the nozzle is advanced, and the area where the water squirted from the spout hole adheres is narrow. Accordingly, when water is squirted from the spout hole in the state in which the nozzle is greatly advanced, it is particularly difficult to cause the water to adhere to the front side of the bowl, etc.

Also, in the sanitary washing device, a shielding plate is provided frontward of the nozzle in the state of being stored in the casing. Therefore, when water is squirted from the spout hole in the state in which the nozzle is stored in the casing, the vertical position of the spout hole can be sufficient; however, the water undesirably impacts the shielding plate, and it is difficult to cause the water to adhere to the front side of the bowl.

SUMMARY

According to the embodiment, a sanitary washing device provided on a toilet including a bowl includes a casing, a nozzle, a shielding plate, and a controller. The nozzle washes a human body private part. The nozzle is advanceable and retractable between a storage position and an advanced position. The nozzle is stored in the casing at the storage position. The nozzle is advanced from the casing at the advanced position. The shielding plate is provided rotatably with respect to the casing. The shielding plate is positioned frontward of the nozzle when the nozzle is at the storage position. The controller controls an operation of the nozzle. The nozzle has a first spout hole squirting water frontward and downward. The shielding plate is at an initial position when the nozzle is at the storage position. The shielding plate is at a first position rotated a first angle from the initial position when the nozzle is at the advanced position. After a use of the sanitary washing device, the controller performs at least a frontward washing operation of squirting water from the first spout hole in a state in which the shielding plate is at a second position rotated a second angle from the initial position. The second angle is less than the first angle. At least a part of the shielding plate is positioned frontward of a front end part of the nozzle in the frontward washing operation.

DETAILED DESCRIPTION

Figure 1:
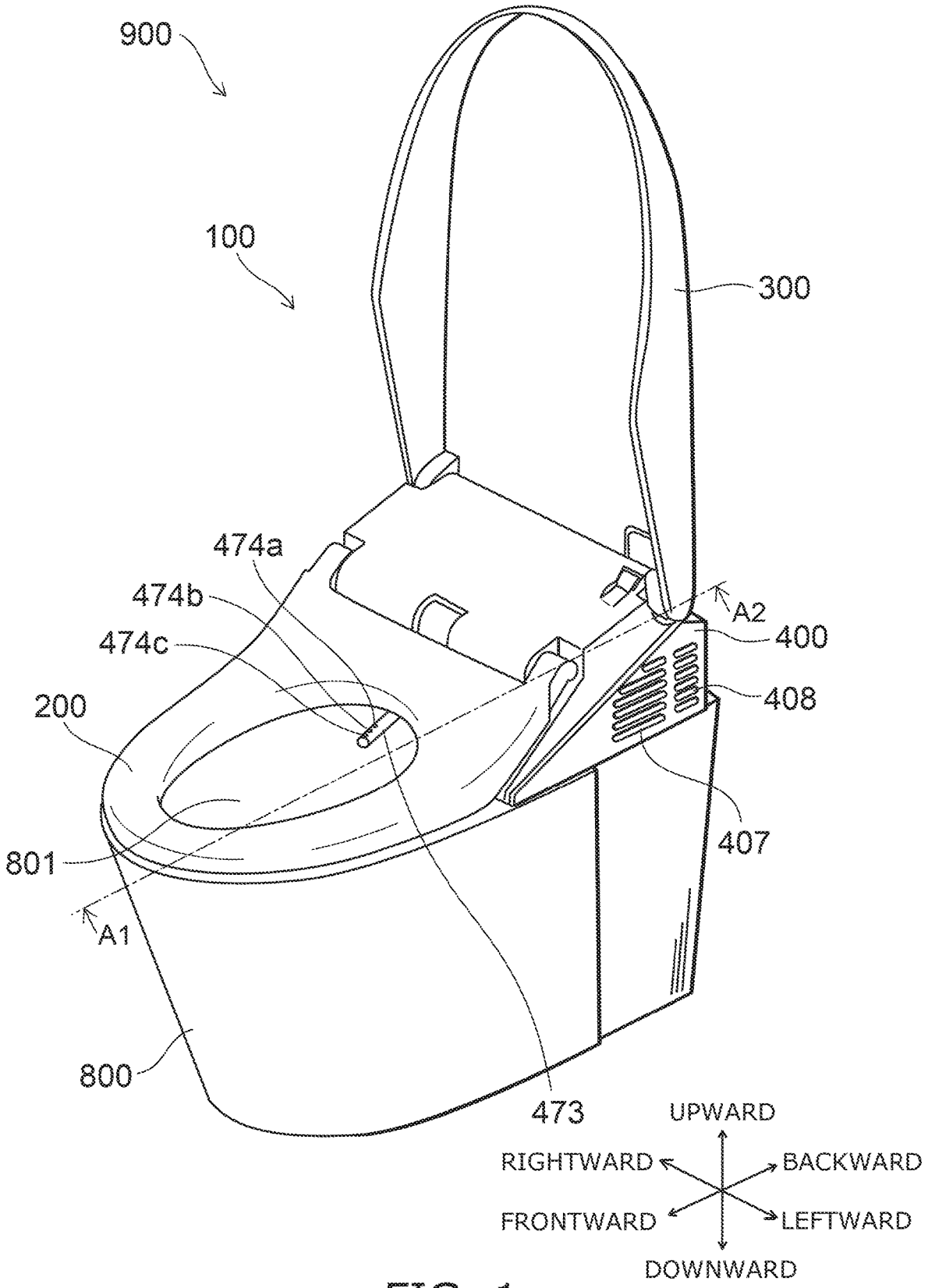
FIG. 1 is a perspective view schematically illustrating a toilet device including a sanitary washing device according to an embodiment.

A first invention is a sanitary washing device provided on a toilet including a bowl, in which the sanitary washing device includes a casing, a nozzle washing a human body private part, a shielding plate provided rotatably with respect to the casing, and a controller controlling an operation of the nozzle; the nozzle is advanceable and retractable between a storage position at which the nozzle is stored in the casing, and an advanced position at which the nozzle is advanced from the casing; the shielding plate is positioned frontward of the nozzle when the nozzle is at the storage position; the nozzle has a first spout hole squirting water frontward and downward; the shielding plate is at an initial position when the nozzle is at the storage position; the shielding plate is at a first position rotated a first angle from the initial position when the nozzle is at the advanced position; the controller performs, after a use of the sanitary washing device, at least a frontward washing operation of squirting water from the first spout hole in a state in which the shielding plate is at a second position rotated a second angle less than the first angle from the initial position; and at least a part of the shielding plate is positioned frontward of a front end part of the nozzle in the frontward washing operation.

According to the sanitary washing device, water is squirted from the first spout hole in the state in which the shielding plate is rotated to the second angle from the initial position; thereby, the obstruction by the shielding plate of the water squirted frontward and downward from the first spout hole can be suppressed, and it is easy to cause the water to adhere to the front side of the bowl. Also, water is squirted from the first spout hole in a state in which the shielding plate is rotated to the second angle which is less than the first angle and at least a part of the shielding plate is positioned frontward of the front end part of the nozzle; thereby, a portion of the water squirted from the first spout hole being squirted out of the bowl and/or being adhered to the closed toilet lid can be suppressed.

A second invention is the sanitary washing device of the first invention, wherein the shielding plate is rotatable by advancing and retracting the nozzle, and the controller performs at least the frontward washing operation in the state in which the shielding plate is rotated from the initial position to the second position by advancing the nozzle from the storage position to a prescribed position between the storage position and the advanced position.

According to the sanitary washing device, the shielding plate that is rotatable by advancing and retracting the nozzle is provided; thereby, the shielding plate can be rotated without separately providing a unit to automatically rotate the shielding plate. Also, by advancing the nozzle to the prescribed position, it is easy to cause the water to adhere to the front side of the bowl, and the position of the first spout hole is low; therefore, a portion of the water squirted from the first spout hole being squirted out of the bowl and/or being adhered to the closed toilet lid can be suppressed more reliably.

A third invention is the sanitary washing device of the first or second invention, wherein the second angle is less than an advance angle of the nozzle with respect to a vertical plane.

According to the sanitary washing device, by setting the second angle to be such an angle, it is easy to cause the water to adhere to the front side of the bowl, and a portion of the water squirted from the first spout hole being squirted out of the bowl and/or being adhered to the closed toilet lid can be suppressed more reliably.

A fourth invention is the sanitary washing device of any one of the first to third inventions, wherein a lower end of the shielding plate when the shielding plate is at the second position is positioned lower than a center of the first spout hole or at a same height as the center of the first spout hole.

According to the sanitary washing device, by setting the second position to be such a position, it is easy to cause the water to adhere to the front side of the bowl, and a portion of the water squirted from the first spout hole being squirted out of the bowl and/or being adhered to the closed toilet lid can be suppressed more reliably.

A fifth invention is the sanitary washing device of any one of the first to fourth inventions, wherein a squirt region of the first spout hole overlaps the shielding plate when the shielding plate is at the initial position, and does not overlap the shielding plate when the shielding plate is at the second position.

According to the sanitary washing device, by setting the second position to be such a position, it is easy to cause the water to adhere to the front side of the bowl, and a portion of the water squirted from the first spout hole being squirted out of the bowl and/or being adhered to the closed toilet lid can be suppressed more reliably.

A sixth invention is the sanitary washing device of any one of the first to fifth inventions that further includes a toilet seat and a seating detection sensor; the seating detection sensor detects a seated state of a user on the toilet seat; and the controller performs at least the frontward washing operation when the seating detection sensor changes from a state of the seated state being detected to a state of the seated state not being detected.

According to the sanitary washing device, a post-use washing such as a frontward washing operation or the like is performed by using, as a trigger, the user not being seated; thereby, the post-use washing can be started directly after using the sanitary washing device. Thereby, the post-use washing can be completed before the next user is seated, and water that contacts the user can be suppressed.

A seventh invention is the sanitary washing device of any one of the first to sixth inventions, wherein the nozzle further has a second spout hole squirting water backward of the first spout hole.

According to the sanitary washing device, the second spout hole that squirts water backward of the first spout hole also is provided; thereby, the water that is squirted from the second spout hole can be caused to adhere to the back side of the bowl to which the water squirted from the first spout hole does not adhere easily. Thereby, water can be caused to adhere to a wider area of the bowl.

An eighth invention is the sanitary washing device of the seventh invention, wherein the controller performs at least a backward washing operation of squirting water from the second spout hole while rotating the shielding plate from the initial position to the second position.

According to the sanitary washing device, by performing the backward washing operation while rotating the shielding plate from the initial position to the second position, water can be caused to adhere to a wider area of the bowl in a shorter period of time.

A ninth invention is the sanitary washing device of the seventh or eighth invention, wherein the first spout hole and the second spout hole are provided in the front end part of the nozzle, and the second spout hole is provided sideward of the first spout hole.

According to the sanitary washing device, the second spout hole is provided sideward of the first spout hole in the front end part of the nozzle; thereby, compared to the case where the second spout hole is provided upward or downward of the first spout hole in the front end part of the nozzle, a long front end part of the nozzle in the vertical direction can be suppressed. Thereby, the length in the vertical direction of the shielding plate can be reduced, and the second angle when performing the frontward washing operation can be reduced. By reducing the second angle, a portion of the water squirted from the first spout hole being squirted out of the bowl and/or being adhered to the closed toilet lid can be suppressed more reliably.

Embodiments of the invention will now be described with reference to the drawings. Similar components in the drawings are marked with the same reference numerals, and a detailed description is omitted as appropriate.

FIG. 1 is a perspective view schematically illustrating a toilet device including a sanitary washing device according to an embodiment.

As illustrated in FIG. 1, the toilet device 900 includes a sit-down flush toilet (a toilet) 800, and a sanitary washing device 100 mounted on the toilet 800. The sanitary washing device 100 includes a casing 400, a toilet seat 200, and a toilet lid 300. The toilet seat 200 and the toilet lid 300 each are pivotally supported to be openable and closable with respect to the casing 400. The toilet 800 includes a bowl 801.

Although "upward", "downward", "frontward", "backward", "rightward", and "leftward" are used in the description of the embodiments recited below, these directions are directions when viewed by a user sitting on the toilet seat 200 as illustrated in FIG. 1.

A private part wash functional unit that realizes the washing of a private part such as a "bottom" or the like of the user sitting on the toilet seat 200, etc., are included inside the casing 400. The private part wash functional unit includes a nozzle 473. The nozzle 473 is advanceable and retractable between a storage position at which the nozzle 473 is stored in the casing 400, and an advanced position at which the nozzle 473 is advanced from the casing 400. The nozzle 473 advances along a linear path toward the center of the bowl 801 positioned frontward and downward of the casing 400, and retracts along the linear path into the casing 400 positioned backward and upward of the bowl 801. The state in which the nozzle 473 is at the advanced position is illustrated in the sanitary washing device 100 illustrated in FIG. 1.

A seating detection sensor 404 that detects the seated state of the user on the toilet seat 200 (referring to FIG. 2) is provided in the sanitary washing device 100. When the seating detection sensor 404 detects the user sitting on the toilet seat 200, for example, the user can advance the nozzle 473 to the advanced position and retract the nozzle 473 to the storage position by operating an operation part 500 such as a remote control, etc. (referring to FIG. 2).

The nozzle 473 washes the human body private part by discharging water (wash water) toward the human body private part in the state of being advanced from the casing 400. A bottom wash water discharge port 474*a*, a gentle wash water discharge port 474*b*, and a bidet wash water discharge port 474*c* are provided in the tip portion of the nozzle 473. The nozzle 473 can wash the "bottom" of the user sitting on the toilet seat 200 by squirting water from the bottom wash water discharge port 474*a* or the gentle wash water discharge port 474*b* provided in the tip. Or, the nozzle 473 can wash a female private part of a female sitting on the toilet seat 200 by squirting water from the bidet wash water discharge port 474*c* provided in the tip. In this specification, "water" includes not only cold water but also warm water that is heated.

The modes of washing the "bottom" include, for example, a "bottom wash" and a "gentle wash" that gently washes using a water stream that is softer than that of the "bottom wash". For example, the nozzle 473 can perform the "bottom wash", the "gentle wash", and the "bidet wash".

In the nozzle 473 illustrated in FIG. 1, the bidet wash water discharge port 474*c* is provided further toward the tip side of the nozzle 473 than is the gentle wash water discharge port 474*b*; the gentle wash water discharge port 474*b* is provided further toward the tip side of the nozzle 473 than is the bottom wash water discharge port 474*a*; however, the placement positions of the bottom wash water discharge port 474*a*, the gentle wash water discharge port 474*b*, and the bidet wash water discharge port 474*c* are not limited thereto. Although three water discharge ports are provided in the nozzle 473 illustrated in FIG. 1, for example, the gentle wash water discharge port 474*b* may be omitted, or four or more water discharge ports may be provided.

Figure 2:
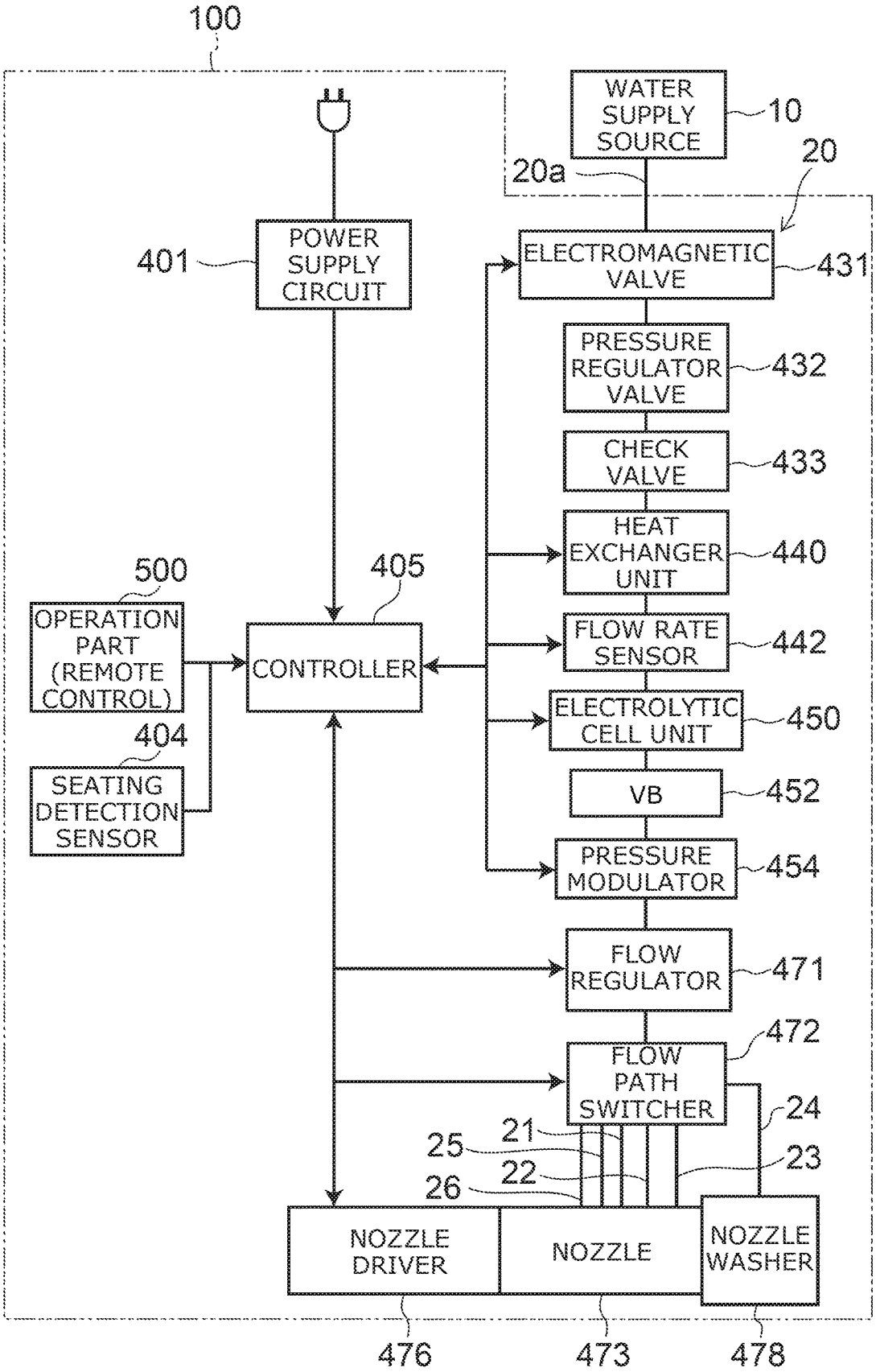
FIG. 2 is a block diagram schematically illustrating the relevant components of the sanitary washing device according to the embodiment.

FIG. 2 is a block diagram schematically illustrating the relevant components of the sanitary washing device according to the embodiment.

The relevant components of the water channel system and the electrical system are illustrated together in FIG. 2.

As illustrated in FIG. 2, the sanitary washing device 100 includes a water transfer part 20. The water transfer part 20 includes a pipe line 20*a* that reaches the nozzle 473 from a water supply source 10 such as a service water line, a water storage tank, etc. The water transfer part 20 guides the water supplied from the water supply source 10 to the nozzle 473 via the pipe line 20*a*. For example, the pipe line 20*a* is formed of components such as an electromagnetic valve 431, a heat exchanger unit 440, a flow path switcher 472, etc., described below and multiple pipes that connect these components.

The electromagnetic valve 431 is provided at the upstream side of the water transfer part 20. The electromagnetic valve 431 is an openable and closable electromagnetic valve and controls the supply of the water based on a command from a controller 405 provided inside the casing 400. In other words, the electromagnetic valve 431 opens and closes the pipe line 20*a*. The water that is supplied from the water supply source 10 is caused to flow in the pipe line 20*a* by setting the electromagnetic valve 431 to the open state.

A pressure regulator valve 432 is provided downstream of the electromagnetic valve 431. The pressure regulator valve 432 regulates the pressure inside the pipe line 20*a* to be within a prescribed pressure range when the water supply pressure is high. A check valve 433 is provided downstream of the pressure regulator valve 432. The check valve 433 suppresses backflow of water toward the upstream side of the check valve 433 when the pressure inside the pipe line 20*a* decreases, etc.

The heat exchanger unit 440 (the heater) is provided downstream of the check valve 433. The heat exchanger unit 440 includes a heater and heats the water supplied from the water supply source 10 to, for example, a specified temperature. In other words, the heat exchanger unit 440 produces warm water.

The heat exchanger unit 440 is, for example, an instant heating type (instantaneous type) heat exchanger using a ceramic heater, etc. Compared to a warm water storage heating type heat exchanger that uses a warm water storage tank, the instant heating type heat exchanger can heat water to a specified temperature in a short period of time. The heat exchanger unit 440 is not limited to an instant heating type heat exchanger and may be a warm water storage heating type heat exchanger. The heater is not limited to a heat exchanger; for example, another heating technique such as, for example, one that utilizes microwave heating, etc., may be used.

The heat exchanger unit 440 is connected to the controller 405. For example, the controller 405 heats the water to the temperature set by the operation part 500 by controlling the heat exchanger unit 440 according to an operation of the operation part 500 by the user.

A flow rate sensor 442 is provided downstream of the heat exchanger unit 440. The flow rate sensor 442 detects the flow rate of the water discharged from the heat exchanger unit 440. In other words, the flow rate sensor 442 detects the flow rate of the water flowing through the pipe line 20*a*. The flow rate sensor 442 is connected to the controller 405. The flow rate sensor 442 inputs the detection result of the flow rate to the controller 405.

An electrolytic cell unit 450 is provided downstream of the flow rate sensor 442. The electrolytic cell unit 450 produces a liquid (functional water) including hypochlorous acid from tap water by electrolyzing the tap water flowing through the interior of the electrolytic cell unit 450. The electrolytic cell unit 450 is connected to the controller 405. The electrolytic cell unit 450 produces the functional water based on a control by the controller 405.

The functional water that is produced by the electrolytic cell unit 450 may be, for example, a solution including metal ions such as silver ions, copper ions, etc. Or, the functional water that is produced by the electrolytic cell unit 450 may be a solution including electrolytic chlorine, ozone, etc. Or, the functional water that is produced by the electrolytic cell unit 450 may be acidic water or alkaline water.

A vacuum breaker (VB) 452 is provided downstream of the electrolytic cell unit 450. The vacuum breaker 452 includes, for example, a flow channel where the water flows, an intake port for intaking air into the flow channel, and a valve mechanism that opens and closes the intake port. For example, the valve mechanism blocks the intake port when water is flowing in the flow channel, and intakes air into the flow channel by opening the intake port when the flow of the water stops. In other words, the vacuum breaker 452 intakes air into the pipe line 20*a* when water does not flow in the water transfer part 20. The valve mechanism includes, for example, a float valve.

For example, by intaking air into the pipe line 20*a* as recited above, the vacuum breaker 452 promotes the water drainage of the part of the pipe line 20*a* downstream of the vacuum breaker 452. For example, the vacuum breaker 452 promotes the water drainage of the nozzle 473. Thus, by draining the water inside the nozzle 473 and intaking air into the nozzle 473, for example, the vacuum breaker 452 suppresses the undesirable backflow of the wash water inside the nozzle 473, the liquid waste collected in the bowl 801, etc., toward the water supply source 10 (the fresh water) side.

A pressure modulator 454 is provided downstream of the vacuum breaker 452. The pressure modulator 454 provides a pulsatory motion to the water discharged from the bottom wash water discharge port 474*a*, the gentle wash water discharge port 474*b*, and the bidet wash water discharge port 474*c* of the nozzle 473 and/or the water discharged from the water discharger of a nozzle washer 478 by providing a pulsatory motion or an acceleration to the flow of the water inside the pipe line 20*a* of the water transfer part 20. In other words, the pressure modulator 454 causes the fluidic state of the water flowing through the pipe line 20*a* to fluctuate. The pressure modulator 454 is connected to the controller 405. The pressure modulator 454 changes the fluidic state of the water to fluctuate based on a control by the controller 405. The pressure modulator 454 changes the pressure of the water inside the pipe line 20*a* to fluctuate.

A flow regulator 471 is provided downstream of the pressure modulator 454. The flow regulator 471 regulates the water force (the flow rate). The flow path switcher 472 is provided downstream of the flow regulator 471. The flow path switcher 472 performs opening and closing and switching of the water supply to the nozzle 473 and/or the nozzle washer 478. The flow regulator 471 and the flow path switcher 472 may be provided as one unit. The flow regulator 471 and the flow path switcher 472 are connected to the controller 405. The operations of the flow regulator 471 and the flow path switcher 472 are controlled by the controller 405.

The nozzle 473 and the nozzle washer 478 are provided downstream of the flow path switcher 472. The nozzle 473 receives a drive force from a nozzle driver 476, advances into the bowl 801 of the toilet 800, and retracts from the interior of the bowl 801.

For example, the nozzle washer 478 washes the outer circumferential surface (the body) of the nozzle 473 by squirting water or functional water from a water discharger.

A bottom wash channel 21, a gentle wash channel 22, and a bidet wash channel 23 that supply, to the nozzle 473, the water supplied from the water supply source 10 or the functional water produced by the electrolytic cell unit 450 via the water transfer part 20 also are provided downstream of the flow path switcher 472. The bottom wash channel 21 connects the flow path switcher 472 and the bottom wash water discharge port 474*a*. The gentle wash channel 22 connects the flow path switcher 472 and the gentle wash water discharge port 474*b*. The bidet wash channel 23 connects the flow path switcher 472 and the bidet wash water discharge port 474*c*.

A surface wash channel 24, a first bowl spout channel 25, and a second bowl spout channel 26 also are provided downstream of the flow path switcher 472. The surface wash channel 24 guides, toward the water discharger of the nozzle washer 478, the water supplied from the water supply source 10 or the functional water produced by the electrolytic cell unit 450 via the water transfer part 20. The first bowl spout channel 25 and the second bowl spout channel 26 guide, to a spout hole 479 of the nozzle 473 (a first spout hole 479*a* and a second spout hole 479*b* described below), the water supplied from the water supply source 10 or the functional water produced by the electrolytic cell unit 450 via the water transfer part 20. The water or the functional water supplied to the spout hole 479 is squirted from the spout hole 479 toward the bowl 801. The second bowl spout channel 26 is omissible when the second spout hole 479*b* is not provided.

By controlling the flow path switcher 472, the controller 405 switches the opening and closing of the flow channels of the bottom wash channel 21, the gentle wash channel 22, the bidet wash channel 23, the surface wash channel 24, the first bowl spout channel 25, and the second bowl spout channel 26. Thus, the flow path switcher 472 switches between the state of communicating with the pipe line 20*a* and the state of not communicating with the pipe line 20*a* for each of the multiple water discharge ports of the bottom wash water discharge port 474*a*, the gentle wash water discharge port 474*b*, the bidet wash water discharge port 474*c*, the nozzle washer 478, the spout hole 479, etc.

Electrical power is supplied to the controller 405 from a power supply circuit 401, and the controller 405 controls the operations of the electromagnetic valve 431, the heat exchanger unit 440, the electrolytic cell unit 450, the pressure modulator 454, the flow regulator 471, the flow path switcher 472, the nozzle driver 476, etc., based on signals from the seating detection sensor 404, the flow rate sensor 442, the operation part 500, etc. Thereby, the controller 405 controls the operation of the nozzle 473.

Various mechanisms such as a "room heating unit", a "deodorizing unit", a "warm air drying function" that dries the "bottom" or the like of the user sitting on the toilet seat 200 by blowing warm air toward the "bottom" or the like, etc., also may be provided as appropriate in the casing 400. In such a case, an exhaust port 407 from the deodorizing unit and a vent 408 from the room heating unit are provided as appropriate in the side surface of the casing 400. However, in the invention, the sanitary washing functional units or the other additional functional units may not always be provided.

Figure 3A:
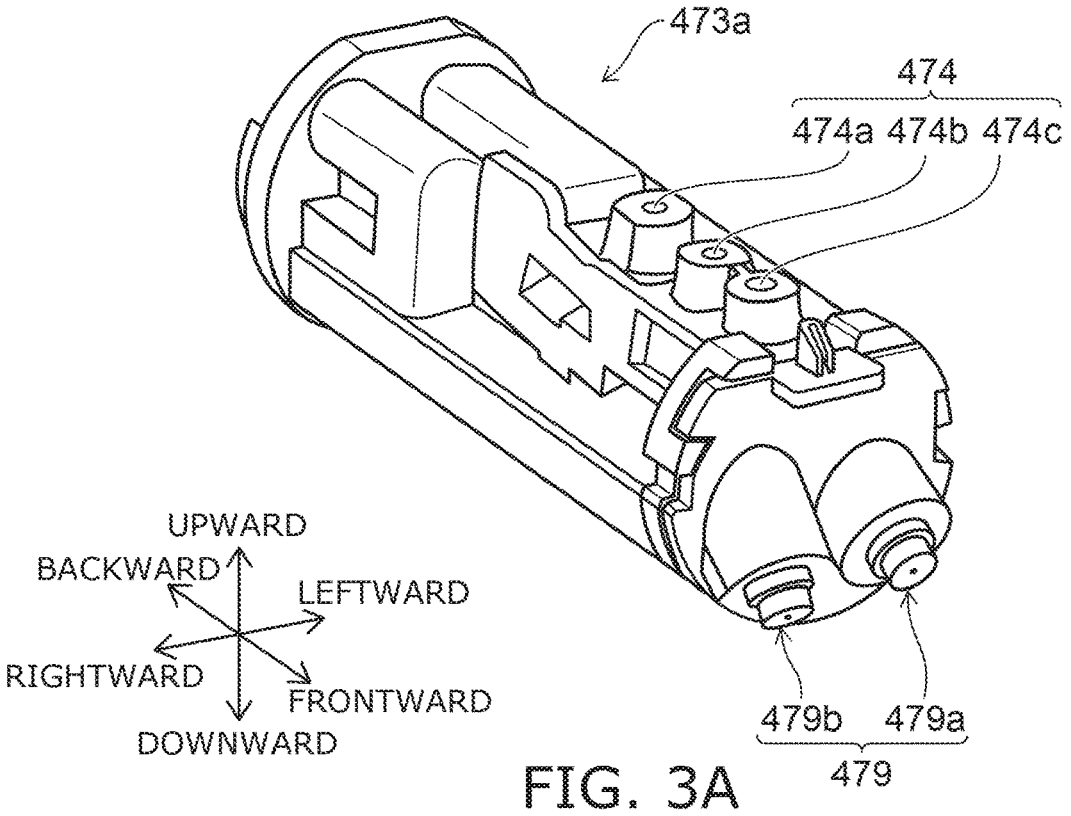
FIG. 3A and FIG. 3B are perspective views schematically illustrating the nozzle of the sanitary washing device according to the embodiment.
Figure 3B:
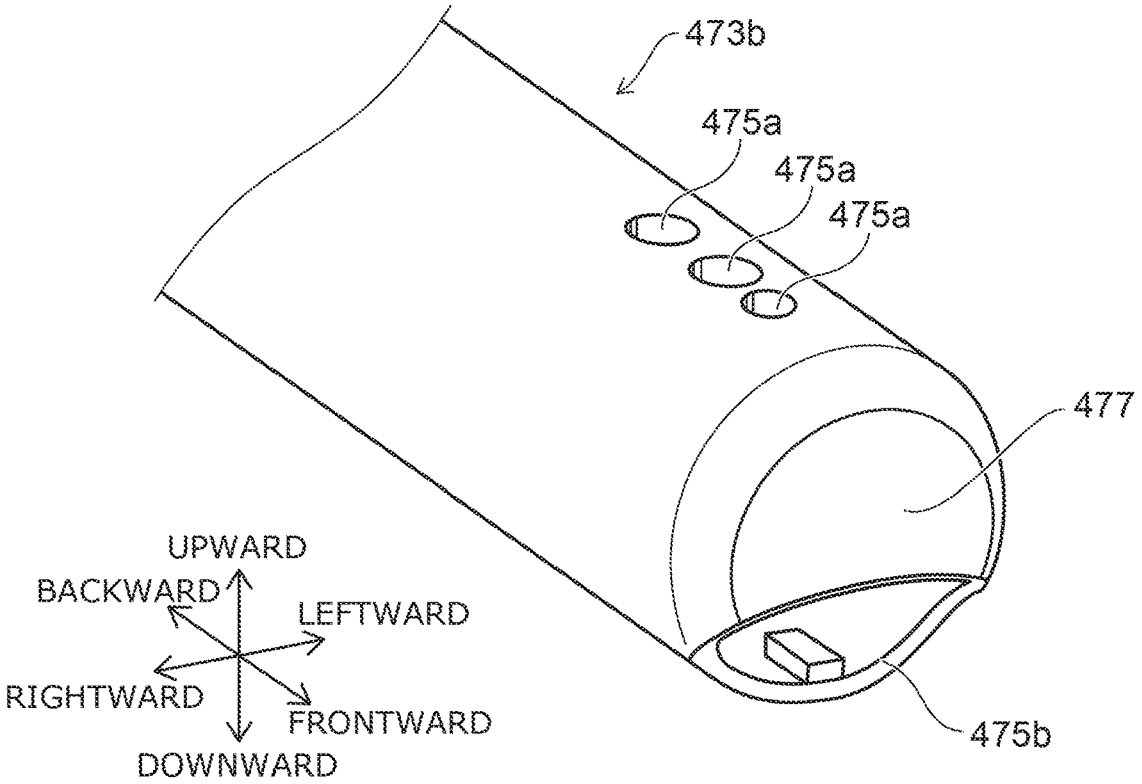

FIG. 3A and FIG. 3B are perspective views schematically illustrating the nozzle of the sanitary washing device according to the embodiment.

Figure 4:
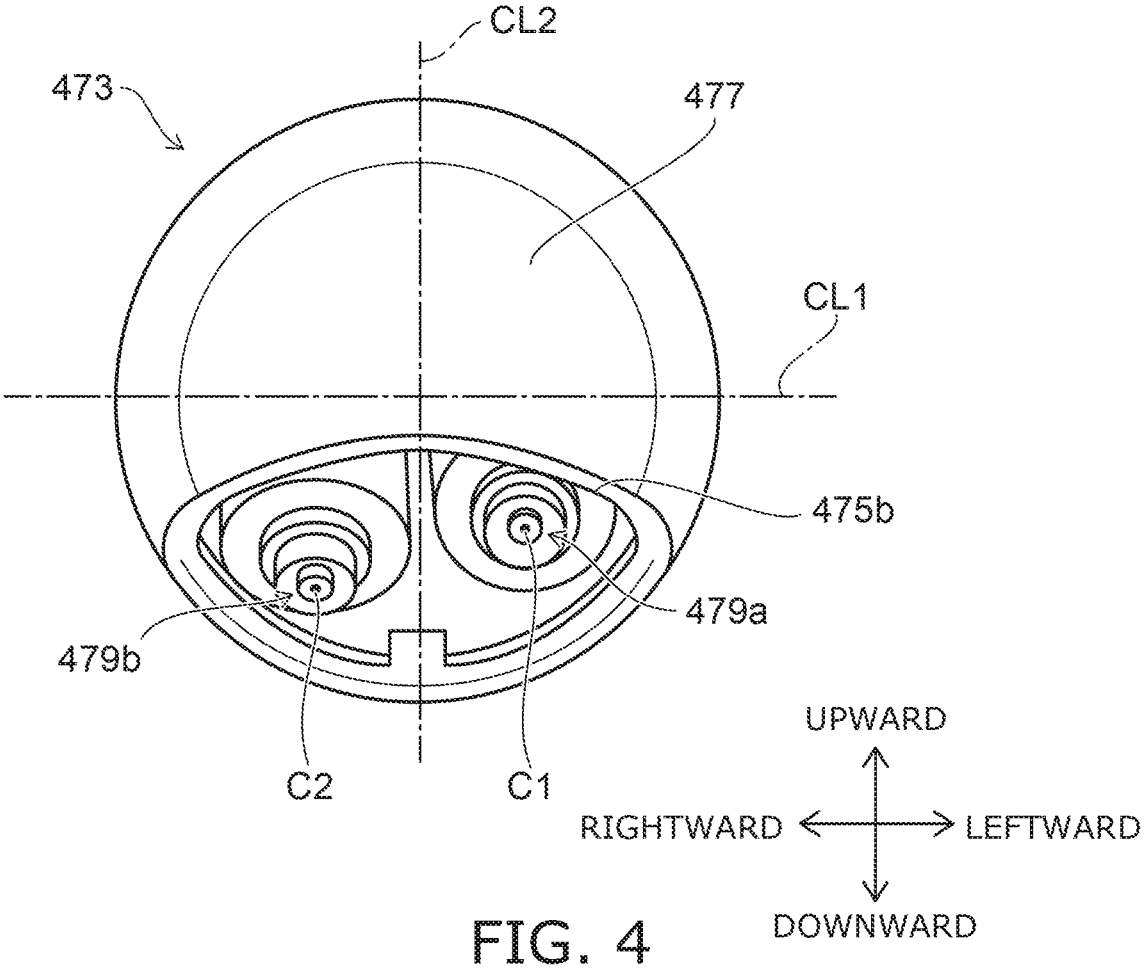
FIG. 4 is a front view schematically illustrating the nozzle of the sanitary washing device according to the embodiment.

FIG. 4 is a front view schematically illustrating the nozzle of the sanitary washing device according to the embodiment.

Figure 5A:
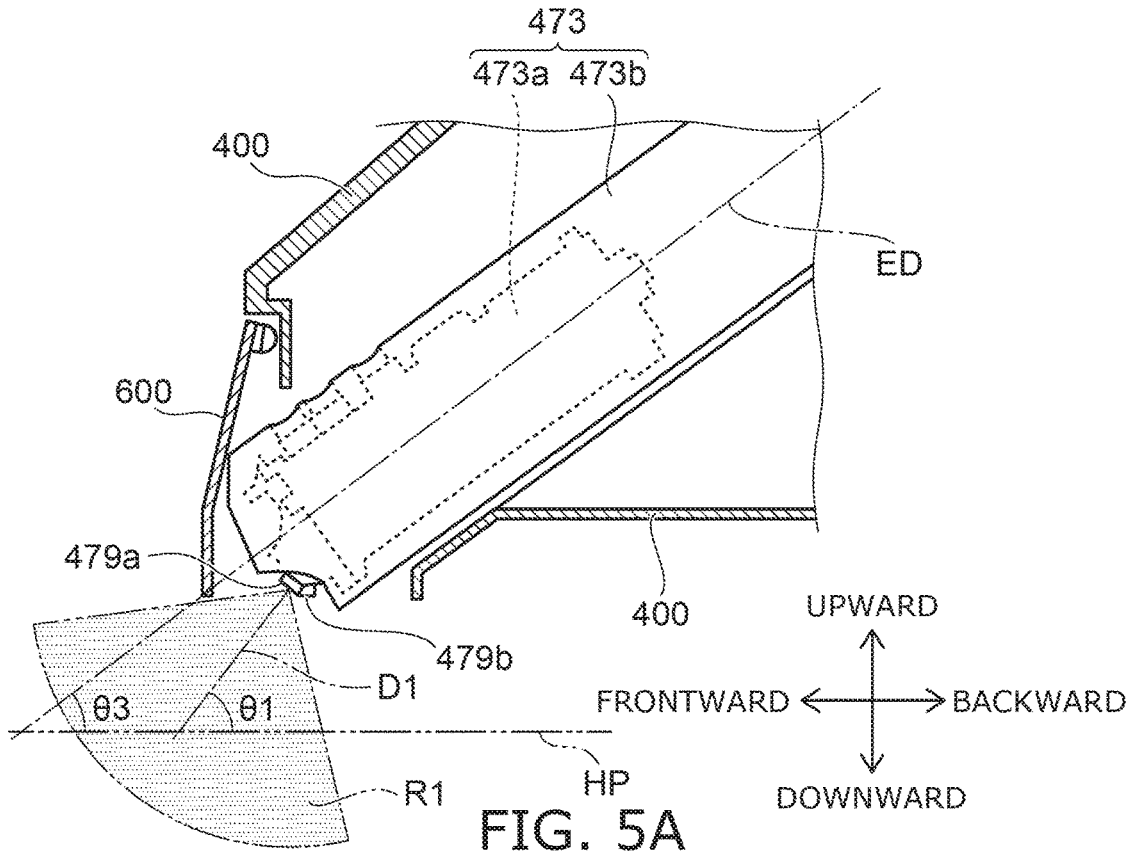
FIG. 5A and FIG. 5B are cross-sectional views schematically illustrating the nozzle periphery of the sanitary washing device according to the embodiment.
Figure 5B:
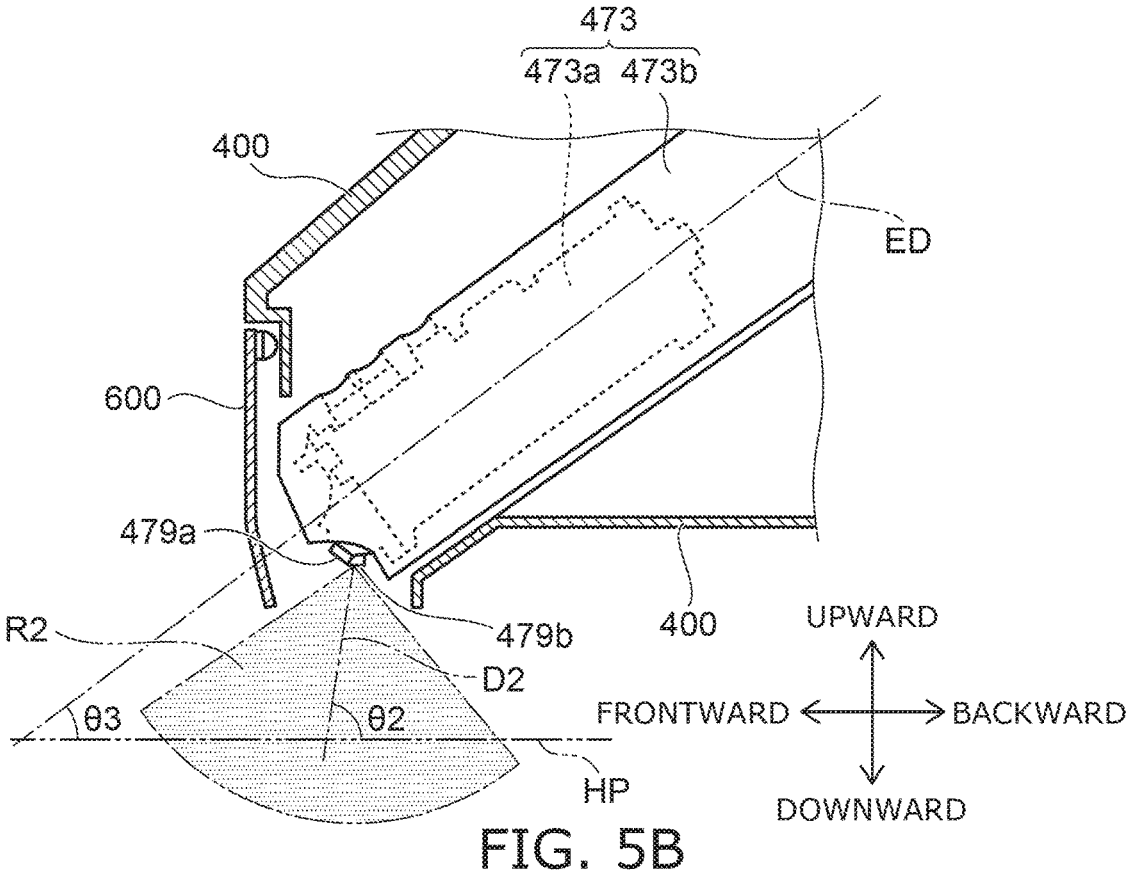

FIG. 5A and FIG. 5B are cross-sectional views schematically illustrating the nozzle periphery of the sanitary washing device according to the embodiment.

FIG. 5A and FIG. 5B illustrate the periphery of the nozzle 473 of the cross section along line A1-A2 shown in FIG. 1.

As illustrated in FIG. 3A, FIG. 3B, FIG. 4, FIG. 5A, and FIG. 5B, the nozzle 473 includes, for example, a nozzle head 473*a* and a nozzle cover 473*b*. The nozzle head 473*a* is stored inside the nozzle cover 473*b*. In other words, the nozzle cover 473*b* covers the nozzle head 473*a*.

Water discharge ports 474 (the bottom wash water discharge port 474*a*, the gentle wash water discharge port 474*b*, and the bidet wash water discharge port 474*c*) that discharge water toward the human body private parts and the spout holes 479 (the first spout hole 479*a* and the second spout hole 479*b*) that squirt water toward the bowl 801 are provided in the nozzle head 473*a*. The nozzle head 473*a* is connected to the bottom wash channel 21, the gentle wash channel 22, the bidet wash channel 23, the first bowl spout channel 25, and the second bowl spout channel 26.

Holes 475*a* that communicate with the water discharge ports 474 (the bottom wash water discharge port 474*a*, the gentle wash water discharge port 474*b*, and the bidet wash water discharge port 474*c*) and a notch 475*b* that exposes the spout holes 479 (the first spout hole 479*a* and the second spout hole 479*b*) are provided in the nozzle cover 473*b*. As illustrated in FIG. 4, for example, the notch 475*b* is provided lower than a center CL1 in the vertical direction of a front end part 477 of the nozzle 473.

Thus, by providing the notch 475*b* exposing the first spout hole 479*a* and the second spout hole 479*b* lower than the center CL1 in the vertical direction of the front end part 477 of the nozzle 473, the notch 475*b* is not too noticeable when viewed by the user. The designability can be improved thereby.

The first spout hole 479*a* and the second spout hole 479*b* will now be described in detail.

FIG. 5A illustrates a state in which water is squirted from the first spout hole 479*a* (i.e., the frontward washing operation described below). FIG. 5B illustrates the state in which water is squirted from the second spout hole 479*b* (i.e., the backward washing operation described below).

For example, the first spout hole 479*a* and the second spout hole 479*b* squirt water in a mist-like form. The particle size of the water squirted from the first spout hole 479*a* and the second spout hole 479*b* is, for example, smaller than the particle size of the water squirted from the bottom wash water discharge port 474*a*, the gentle wash water discharge port 474*b*, and the bidet wash water discharge port 474*c*. The particle size of the water squirted from the first spout hole 479*a* and the second spout hole 479*b* is, for example, about 400 μm.

As illustrated in FIG. 5A, the first spout hole 479*a* is open frontward and downward. The first spout hole 479*a* squirts water frontward and downward. More specifically, the first spout hole 479*a* squirts water at a first squirt angle θ1 with respect to a horizontal plane HP. The first squirt angle θ1 is the angle between the horizontal plane HP and a first squirt direction D1 of the water squirted from the first spout hole 479*a*. For example, the first squirt direction D1 can be illustrated by the center line of a squirt region R1 of the water squirted from the first spout hole 479*a*. For example, the first squirt direction D1 may be illustrated by a normal of the first spout hole 479*a*.

For example, the first squirt angle θ1 is greater than an advance angle θ3 of the nozzle 473 with respect to the horizontal plane HP. The advance angle θ3 is the angle between the horizontal plane HP and an advance direction ED of the nozzle 473. In other words, for example, the first spout hole 479*a* squirts water backward of the advance direction ED of the nozzle 473. The first squirt angle θ1 is acute. The first squirt angle θ1 is, for example, not less than 38 degrees and not more than 72 degrees.

As illustrated in FIG. 5B, the second spout hole 479*b* is open backward of the first spout hole 479*a*. The second spout hole 479*b* squirts water backward of the first spout hole 479*a*. More specifically, the second spout hole 479*b* squirts water at a second squirt angle θ2 with respect to the horizontal plane HP. The second squirt angle θ2 is the angle between the horizontal plane HP and a second squirt direction D2 of the water squirted from the second spout hole 479*b*. For example, the second squirt direction D2 can be illustrated by the center line of a squirt region R2 of the water squirted from the second spout hole 479*b*. For example, the second squirt direction D2 may be illustrated by a normal of the second spout hole 479*b*.

For example, the second squirt angle θ2 is greater than the advance angle θ3 of the nozzle 473 with respect to the horizontal plane HP. In other words, for example, the second spout hole 479*b* squirts water backward of the advance direction ED of the nozzle 473. The second squirt angle θ2 is greater than the first squirt angle θ1. In other words, the second spout hole 479*b* squirts water backward of the first spout hole 479*a*. The second squirt angle θ2 is, for example, not less than 72 degrees and not more than 90 degrees.

Thus, by providing the two spout holes 479 (the first spout hole 479*a* and the second spout hole 479*b*) squirting water in different orientations in the frontward and backward directions, water can be caused to adhere to a wider area of the bowl 801. More specifically, water can be caused to adhere to the front side of the bowl 801 by the first spout hole 479*a* squirting water frontward and downward, and water can be caused to adhere to the back side of the bowl 801 by the second spout hole 479*b* squirting water backward of the first spout hole 479*a*. Thereby, the water that is squirted from the second spout hole 479*b* can be caused to adhere to the back side of the bowl 801 to which the water squirted from the first spout hole 479*a* does not adhere easily, and water can be caused to adhere to a wider area of the bowl 801.

As illustrated in FIG. 4, the second spout hole 479*b* is provided sideward of the first spout hole 479*a*. More specifically, the second spout hole 479*b* does not overlap the first spout hole 479*a* in the vertical direction. For example, at least a part of the second spout hole 479*b* overlaps the first spout hole 479*a* in the lateral direction. For example, the first spout hole 479*a* is positioned at one side (in the example, the left side) of a center CL2 in the lateral direction of the front end part 477 of the nozzle 473, and the second spout hole 479*b* is positioned at the other side (in the example, the right side) of the center CL2 in the lateral direction.

The first spout hole 479*a* may be positioned at the right side of the center CL2 in the lateral direction of the front end part 477 of the nozzle 473, and the second spout hole 479*b* may be positioned at the left side of the center CL2 in the lateral direction. In other words, the position in the lateral direction of the first spout hole 479*a* and the position in the lateral direction of the second spout hole 479*b* may be reversed.

Thus, by providing the second spout hole 479*b* sideward of the first spout hole 479*a*, even when the orientation in which the water of the first spout hole 479*a* is squirted and the orientation in which the water of the second spout hole 479*b* is squirted are different, the undesirable contact of the water squirted from one of the spout holes 479 (e.g., the second spout hole 479*b*) with the other of the spout holes 479 (e.g., the first spout hole 479*a*) can be suppressed. The degrees of freedom of the design of the orientations in which the water of the spout holes 479 is squirted can be increased thereby. Accordingly, water can be squirted more frontward from the first spout hole 479*a*, and more water can be easily caused to adhere to the front side of the bowl 801.

Also, as illustrated in FIG. 4, for example, the first spout hole 479*a* is positioned higher than the second spout hole 479*b*. More specifically, a center C1 of the first spout hole 479*a* is positioned higher than a center C2 of the second spout hole 479*b*.

Thus, by disposing the center C1 of the first spout hole 479*a* higher than the center C2 of the second spout hole 479*b*, the undesirable contact of the water squirted from one of the spout holes 479 (e.g., the second spout hole 479*b*) with the other of the spout holes 479 (e.g., the first spout hole 479*a*) can be suppressed more reliably.

As illustrated in FIG. 4, for example, the first spout hole 479*a* and the second spout hole 479*b* are provided in the front end part 477 of the nozzle 473. More specifically, for example, the first spout hole 479*a* and the second spout hole 479*b* are provided lower than the center CL1 in the vertical direction of the front end part 477 of the nozzle 473.

Thus, by providing the first spout hole 479*a* and the second spout hole 479*b* in the front end part 477 of the nozzle 473, water can be squirted more frontward from the first spout hole 479*a*. Thereby, more water can be easily caused to adhere to the front side of the bowl 801.

In the embodiment, the second spout hole 479*b* is provided as necessary and is omissible. In other words, it is sufficient for the nozzle 473 to have at least the first spout hole 479*a*. When the second spout hole 479*b* is not provided, for example, the first spout hole 479*a* is provided to overlap the center CL2 in the lateral direction of the front end part 477 of the nozzle 473.

Figure 6A:
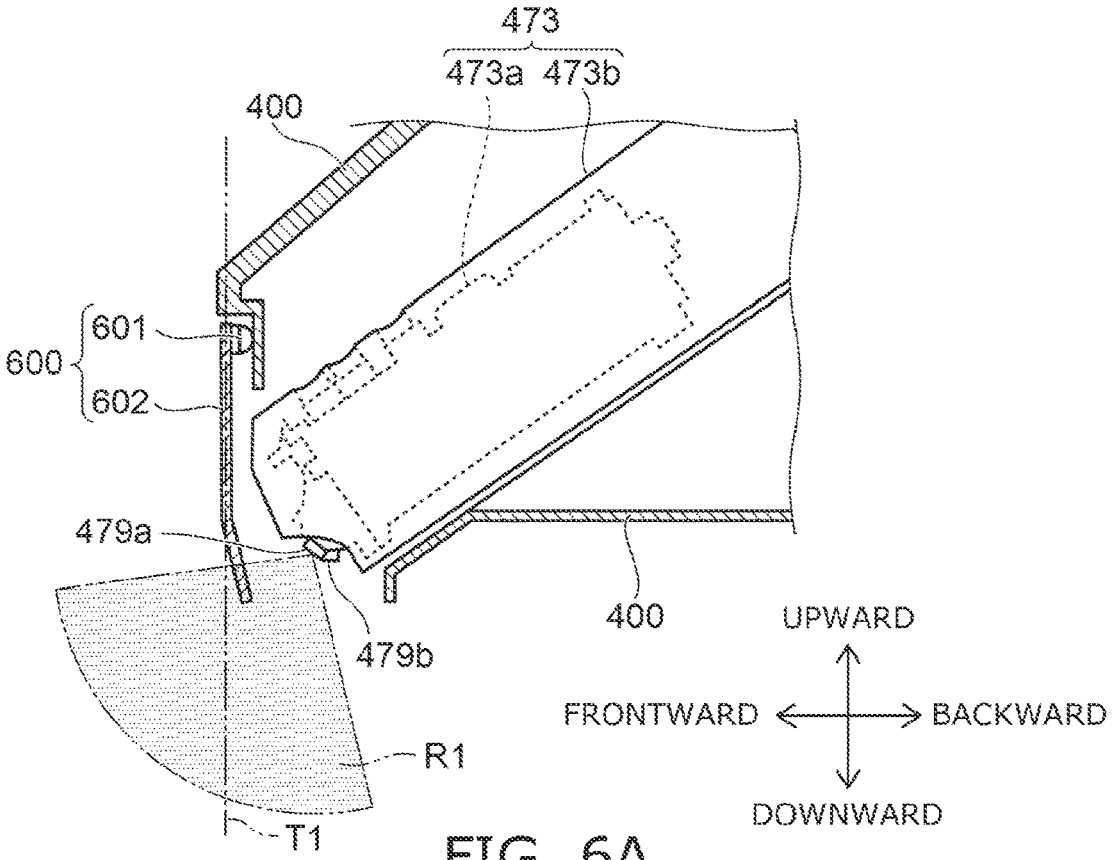
FIG. 6A and FIG. 6B are cross-sectional views schematically illustrating the nozzle periphery of the sanitary washing device according to the embodiment.
Figure 6B:
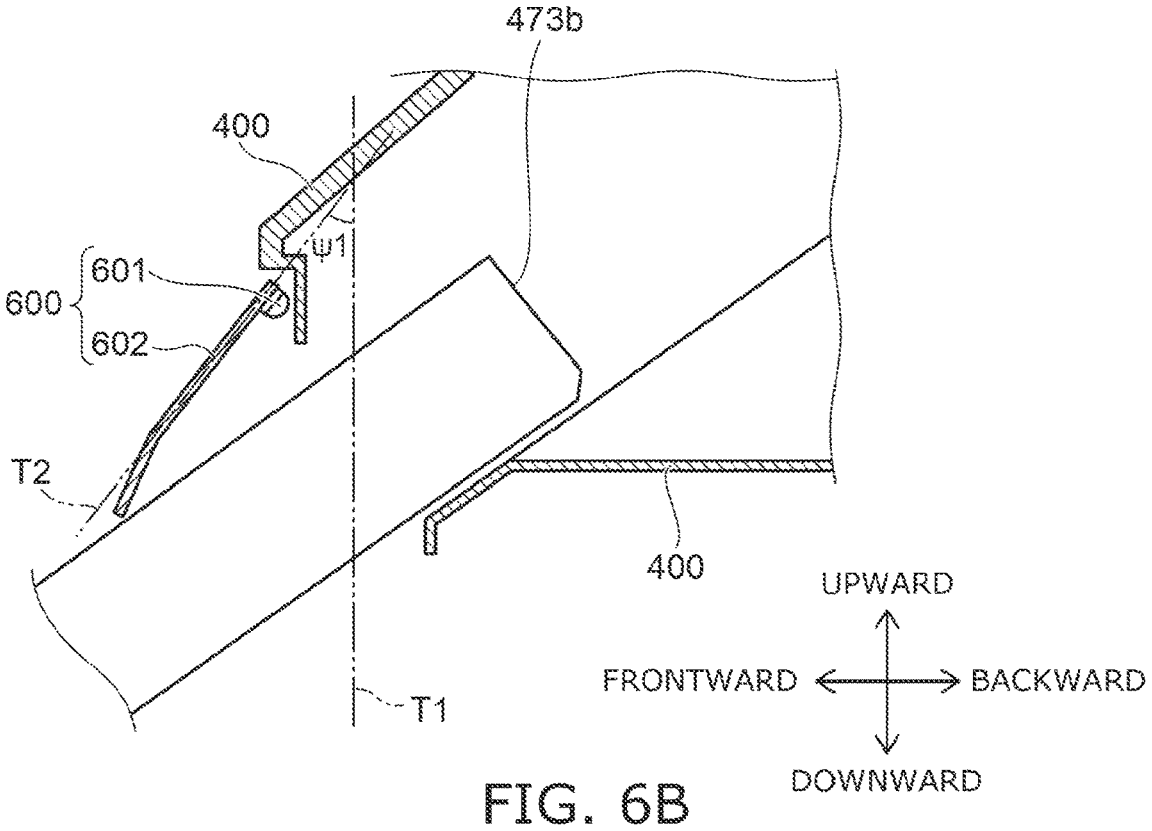

FIG. 6A and FIG. 6B are cross-sectional views schematically illustrating the nozzle periphery of the sanitary washing device according to the embodiment.

FIG. 6A illustrates the state in which the nozzle 473 is at the storage position. FIG. 6B illustrates the state in which the nozzle 473 is at the advanced position.

As illustrated in FIG. 6A and FIG. 6B, the sanitary washing device 100 according to the embodiment includes a shielding plate 600. The shielding plate 600 is provided rotatably with respect to the casing 400.

As illustrated in FIG. 6A, the shielding plate 600 is at the initial position when the nozzle 473 is at the storage position. The shielding plate 600 is positioned frontward of the nozzle 473 when the shielding plate 600 is at the initial position. As illustrated in FIG. 6B, the shielding plate 600 is at the first position when the nozzle 473 is at the advanced position. The shielding plate 600 is positioned upward of the nozzle 473 when the shielding plate 600 is at the first position.

When the nozzle 473 advances from the storage position to the advanced position, the shielding plate 600 rotates from the initial position to the first position. The first position is a position rotated a first angle ψ1 from the initial position.

At the initial position, for example, the shielding plate 600 is provided parallel to a vertical plane. At the initial position, for example, the shielding plate 600 may be tilted greater than 0 degrees and not more than 3 degrees with respect to the vertical plane. In other words, the angle between the vertical plane and a first tilt direction T1 of the shielding plate 600 at the initial position is, for example, not less than 0 degrees and not more than 3 degrees. For example, the first tilt direction T1 can be illustrated by a straight line along a downward extension part 602 extending downward from a pivotally-supporting part 601 of the shielding plate 600 at the initial position. For example, the first tilt direction T1 may be illustrated by a straight line connecting the upper end and the lower end of the shielding plate 600 at the initial position.

The first angle ψ1 is the angle between the first tilt direction T1 of the shielding plate 600 at the initial position and a second tilt direction T2 of the shielding plate 600 at the first position. For example, the second tilt direction T2 can be illustrated by a straight line along the downward extension part 602 extending downward from the pivotally-supporting part 601 of the shielding plate 600 at the first position. For example, the second tilt direction T2 may be illustrated by a straight line connecting the upper end and the lower end of the shielding plate 600 at the first position. The first angle ψ1 is, for example, not less than 25 degrees and not more than 45 degrees.

Figure 7:
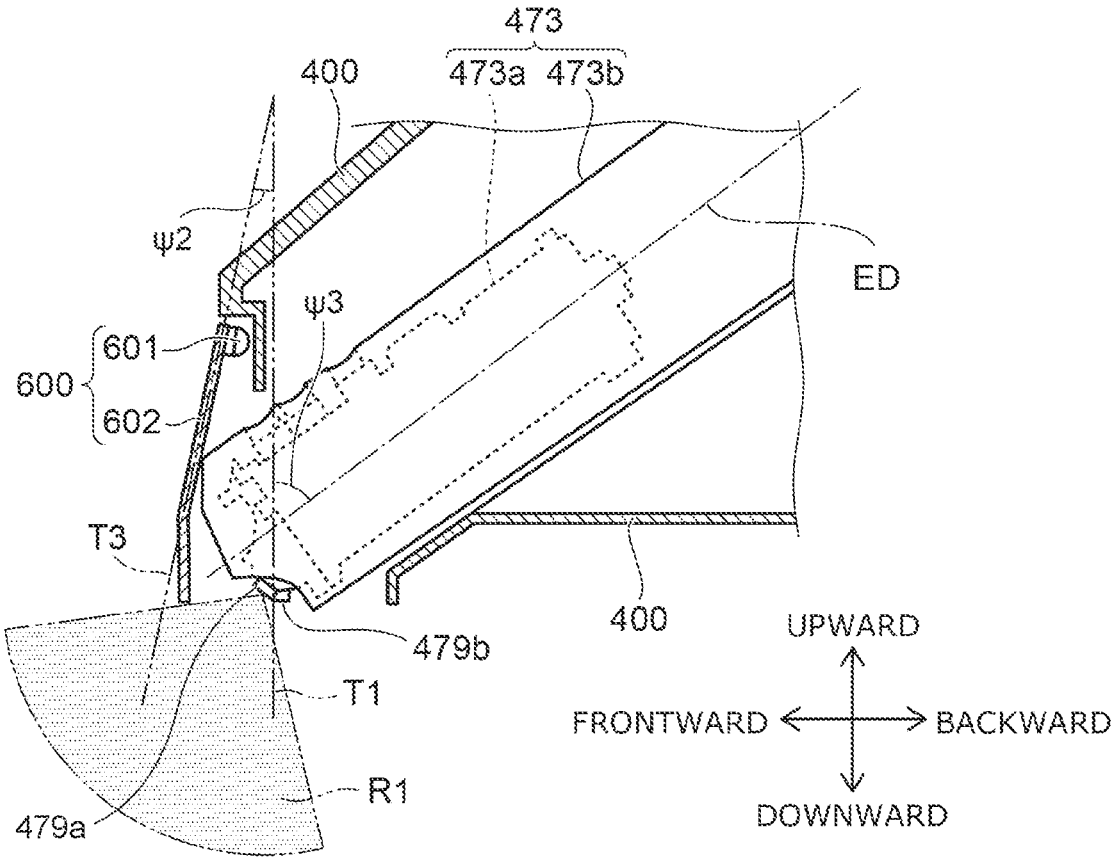
FIG. 7 is a cross-sectional view schematically illustrating the nozzle periphery of the sanitary washing device according to the embodiment.

FIG. 7 is a cross-sectional view schematically illustrating the nozzle periphery of the sanitary washing device according to the embodiment.

In the embodiment, the controller 405 performs a post-use washing after using the sanitary washing device 100. In the post-use washing as illustrated in FIG. 7, the controller 405 performs the frontward washing operation of squirting water from the first spout hole 479*a* in a state in which the shielding plate 600 is at the second position which is rotated a second angle ψ2 from the initial position.

The second angle ψ2 is the angle between the first tilt direction T1 of the shielding plate 600 at the initial position and a third tilt direction T3 of the shielding plate 600 at the second position. For example, the third tilt direction T3 can be illustrated by a straight line along the downward extension part 602 extending downward from the pivotally-supporting part 601 of the shielding plate 600 at the second position. For example, the third tilt direction T3 may be illustrated by a straight line connecting the upper end and the lower end of the shielding plate 600 at the second position. The second angle ψ2 is, for example, not less than 3 degrees and not more than 25 degrees.

The second angle ψ2 is greater than 0 degrees. The second angle ψ2 is less than the first angle ψ1. In other words, the shielding plate 600 (at the second position) when performing the frontward washing operation is in a state that is more open than the shielding plate 600 (at the initial position) when the nozzle 473 is at the storage position and in a state that is more closed than the shielding plate 600 (at the first position) when the nozzle 473 is at the advanced position. At least a part of the shielding plate 600 in the frontward washing operation (when the shielding plate 600 is at the second position) is positioned frontward of the front end part 477 of the nozzle 473.

Thus, by squirting water from the first spout hole 479*a* in the state in which the shielding plate 600 is rotated to the second angle ψ2 from the initial position, the obstruction by the shielding plate 600 of the water squirted frontward and downward from the first spout hole 479*a* can be suppressed, and water is easily caused to adhere to the front side of the bowl 801.

Also, by squirting water from the first spout hole 479*a* in the state in which the shielding plate 600 is rotated to the second angle ψ2 which is less than the first angle ψ1 and at least a part of the shielding plate 600 is positioned frontward of the front end part 477 of the nozzle 473, a portion of the water squirted from the first spout hole 479*a* being squirted out of the bowl 801 and/or adhering to the closed toilet lid 300 can be suppressed.

In the example, the shielding plate 600 is rotatable by advancing and retracting the nozzle 473. The controller 405 performs the frontward washing operation in the state in which the shielding plate 600 is rotated from the prescribed position to the second position by advancing the nozzle 473 from the storage position to a prescribed position between the storage position and the advanced position.

Thus, by providing the shielding plate 600 that is rotatable by advancing and retracting the nozzle 473, the shielding plate 600 can be rotated without separately providing a unit that automatically rotates the shielding plate 600. Also, by advancing the nozzle 473 to the prescribed position, water is easily caused to adhere to the front side of the bowl 801, and the position of the first spout hole 479*a* is low; therefore, a portion of the water squirted from the first spout hole 479*a* being squirted out of the bowl and/or adhering to the closed toilet lid 300 can be suppressed more reliably.

As illustrated in FIG. 7, the second angle $\phi$2 is, for example, less than an advance angle $\phi$3 of the nozzle 473 with respect to the vertical plane VP. The advance angle $\phi$3 is the angle between the vertical plane and the advance direction ED of the nozzle 473. By setting the second angle $\phi$2 to be such an angle, water is easily caused to adhere to the front side of the bowl 801, and a portion of the water squirted from the first spout hole 479*a* being squirted out of the bowl 801 and/or adhering to the closed toilet lid 300 can be suppressed more reliably.

For example, when the shielding plate 600 is at the second position, the lower end of the shielding plate 600 is positioned lower than the center C1 of the first spout hole 479*a* or at the same height as the center C1 of the first spout hole 479*a*. In other words, for example, the second angle $\psi$2 is set to be an angle such that the lower end of the shielding plate 600 is positioned lower than the center C1 of the first spout hole 479*a* or at the same height as the center C1 of the first spout hole 479*a*. By setting the second angle $\psi$2 to be such an angle (by setting the second position to be such a position), water is easily caused to adhere to the front side of the bowl 801, and a portion of the water squirted from the first spout hole 479*a* being squirted out of the bowl 801 and/or adhering to the closed toilet lid 300 can be suppressed more reliably.

In FIG. 6A and FIG. 7, the squirt region R1 is the squirt region when water is squirted from the first spout hole 479*a*. As illustrated in FIG. 6A, the squirt region R1 overlaps the shielding plate 600 when the shielding plate 600 is at the initial position. That is, when water is squirted from the first spout hole 479*a* in the state in which the shielding plate 600 is at the initial position, the water undesirably is obstructed by the shielding plate 600.

Conversely, as illustrated in FIG. 7, the squirt region R1 does not overlap the shielding plate 600 when the shielding plate 600 is at the second position. In other words, for example, the second angle $\psi$2 is set to an angle such that the squirt region R1 of the first spout hole 479*a* does not overlap the shielding plate 600. By setting the second angle $\psi$2 to be such an angle (by setting the second position to be such a position), water is easily caused to adhere to the front side of the bowl 801, and a portion of the water squirted from the first spout hole 479*a* being squirted out of the bowl 801 and/or adhering to the closed toilet lid 300 can be suppressed more reliably.

In the embodiment as illustrated in FIG. 4, the first spout hole 479*a* and the second spout hole 479*b* are provided in the front end part 477 of the nozzle 473. The second spout hole 479*b* is provided sideward of the first spout hole 479*a*. Thus, by providing the second spout hole 479*b* sideward of the first spout hole 479*a* in the front end part 477 of the nozzle 473, compared to the case where the second spout hole 479*b* is provided upward or downward of the first spout hole 479*a* in the front end part 477 of the nozzle, a long front end part 477 of the nozzle 473 in the vertical direction can be suppressed. Thereby, the length in the vertical direction of the shielding plate 600 can be reduced, and the second angle $\psi$2 when performing the frontward washing operation can be reduced. By reducing the second angle $\psi$2, a portion of the water squirted from the first spout hole 479*a* being squirted out of the bowl 801 and/or adhering to the closed toilet lid 300 can be suppressed more reliably.

The water that is squirted from the spout hole 479 in the post-use washing may be functional water produced by the electrolytic cell unit 450.

Figure 8:
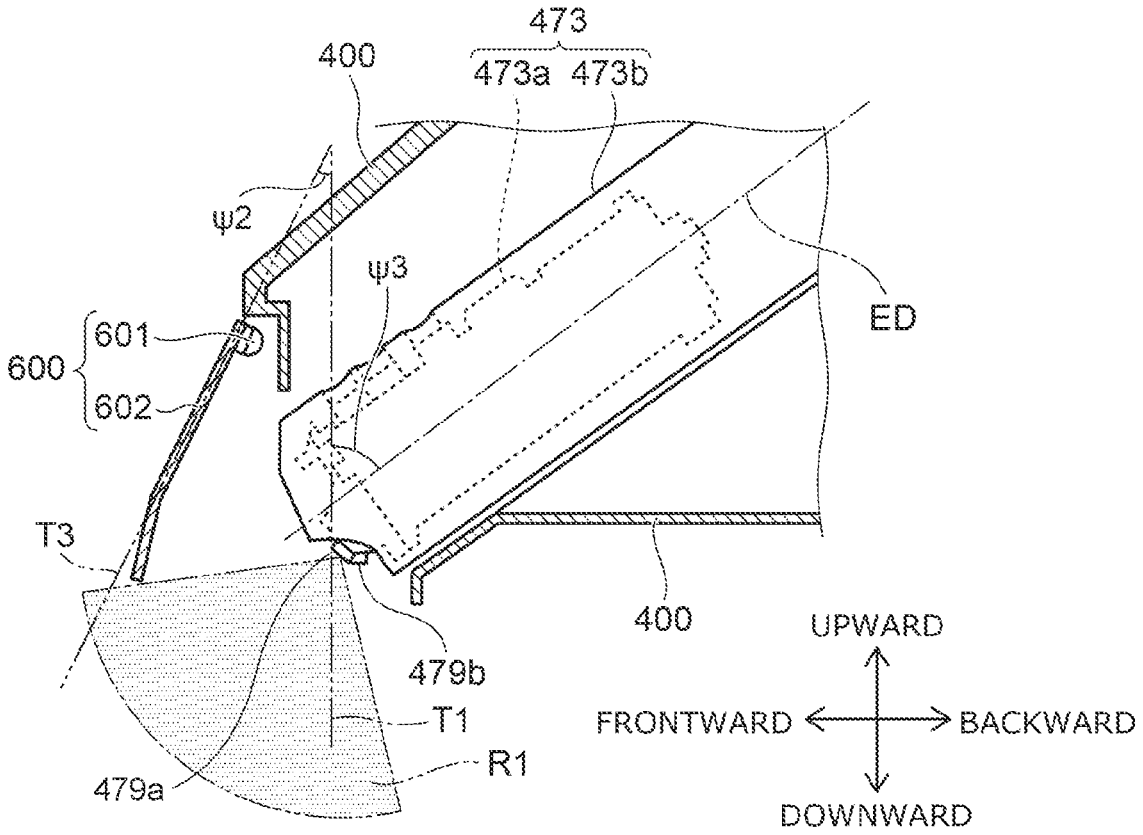
FIG. 8 is a cross-sectional view schematically illustrating the nozzle periphery of a modification of the sanitary washing device according to the embodiment.

FIG. 8 is a cross-sectional view schematically illustrating the nozzle periphery of a modification of the sanitary washing device according to the embodiment.

In the embodiment, the sanitary washing device 100 may include a unit (a drive unit) that automatically rotates the shielding plate 600. In such a case, as illustrated in FIG. 8, the controller 405 may perform the frontward washing operation by rotating the shielding plate 600 from the initial position to the second position by the drive unit without advancing the nozzle 473.

In the example as well, by squirting water from the first spout hole 479*a* in the state in which the shielding plate 600 is rotated from the initial position to the second angle $\psi$2, the obstruction by the shielding plate 600 of the water that is squirted frontward and downward from the first spout hole 479*a* can be suppressed, and water is easily caused to adhere to the front side of the bowl 801.

Figure 9:
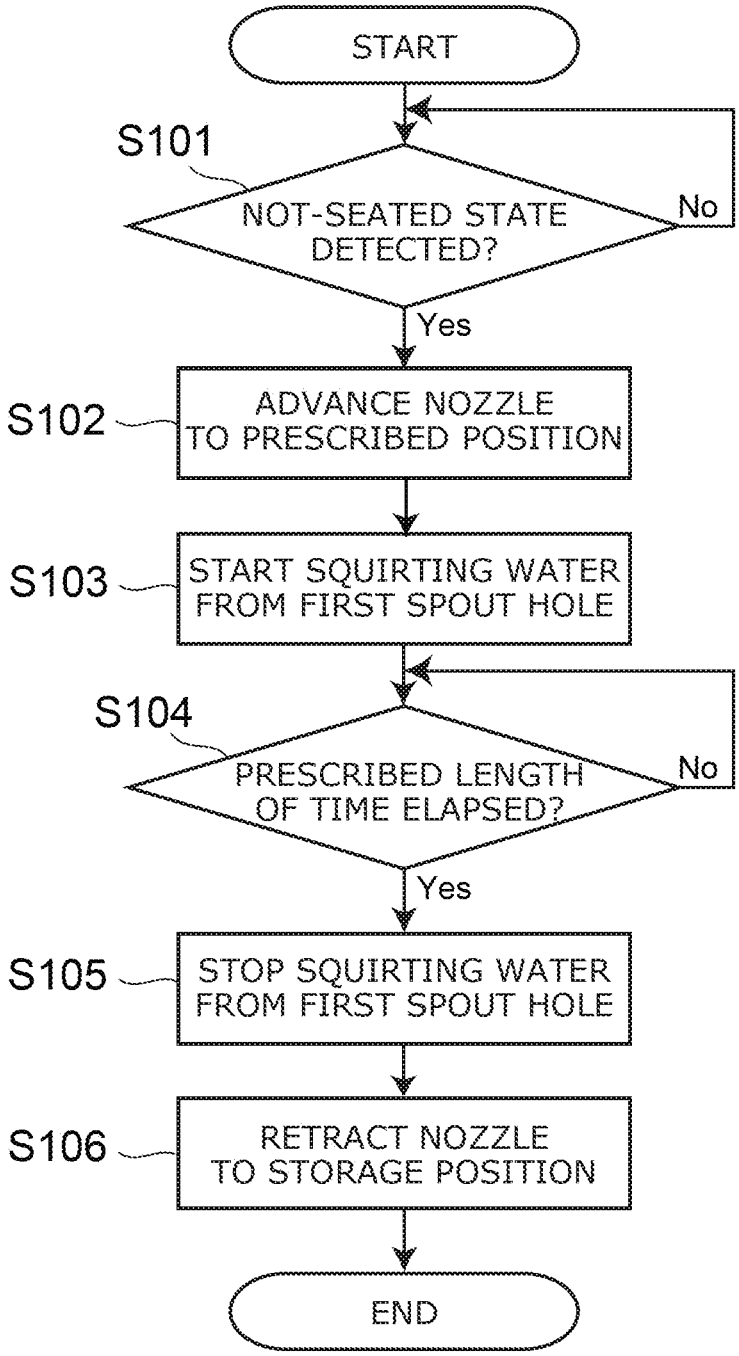
FIG. 9 is a flowchart illustrating an example of the operation of the sanitary washing device according to the embodiment.

FIG. 9 is a flowchart illustrating an example of the operation of the sanitary washing device according to the embodiment.

An example will now be described with reference to FIG. 9 for the flow when performing only the squirting of the water from the first spout hole 479*a* (the frontward washing operation) in the post-use washing.

In the example as illustrated in FIG. 9, when the seating detection sensor 404 changes from the state of the seated state being detected to the state of the seated state not being detected (step S101: Yes), the controller 405 advances the nozzle 473 to the prescribed position (step S102). Thereby, the shielding plate 600 can be in the state of being rotated from the initial position to the second position.

Thus, a post-use washing such as the frontward washing operation or the like is performed by using, as a trigger, the user not being seated; thereby, the post-use washing can be started directly after using the sanitary washing device 100. Thereby, the post-use washing can be completed before the next user is seated, and water that contacts the user can be suppressed.

The trigger of the post-use washing is not limited to the user not being seated. For example, the controller 405 may perform the post-use washing by using, as a trigger, the user exiting the toilet room, the toilet flush button operation, etc.

When the nozzle 473 is advanced to the prescribed position, the controller 405 starts squirting water from the first spout hole 479*a* (the frontward washing operation) (step S103). After squirting water from the first spout hole 479*a* for a prescribed period of time (e.g., 6 seconds) (step S104: Yes), the controller 405 stops squirting water from the first spout hole 479*a* (the frontward washing operation) (step S105).

When the squirting of the water from the first spout hole 479*a* is stopped, the controller 405 retracts the nozzle 473 to the storage position (step S106).

Step S103 may be performed after starting step S102 and before step S102 is completed. In other words, the controller 405 may start squirting water from the first spout hole 479*a* while advancing the nozzle 473. Also, step S103 may be performed before step S102. In other words, the controller 405 may start squirting water from the first spout hole 479*a* before advancing the nozzle 473.

Step S105 may be performed after step S106. In other words, the controller 405 may stop squirting water from the first spout hole 479*a* after retracting the nozzle 473. Also, step S105 may be performed after starting step S106 and before step S106 is completed. In other words, the controller 405 may stop squirting water from the first spout hole 479*a* while retracting the nozzle 473.

Figure 10:
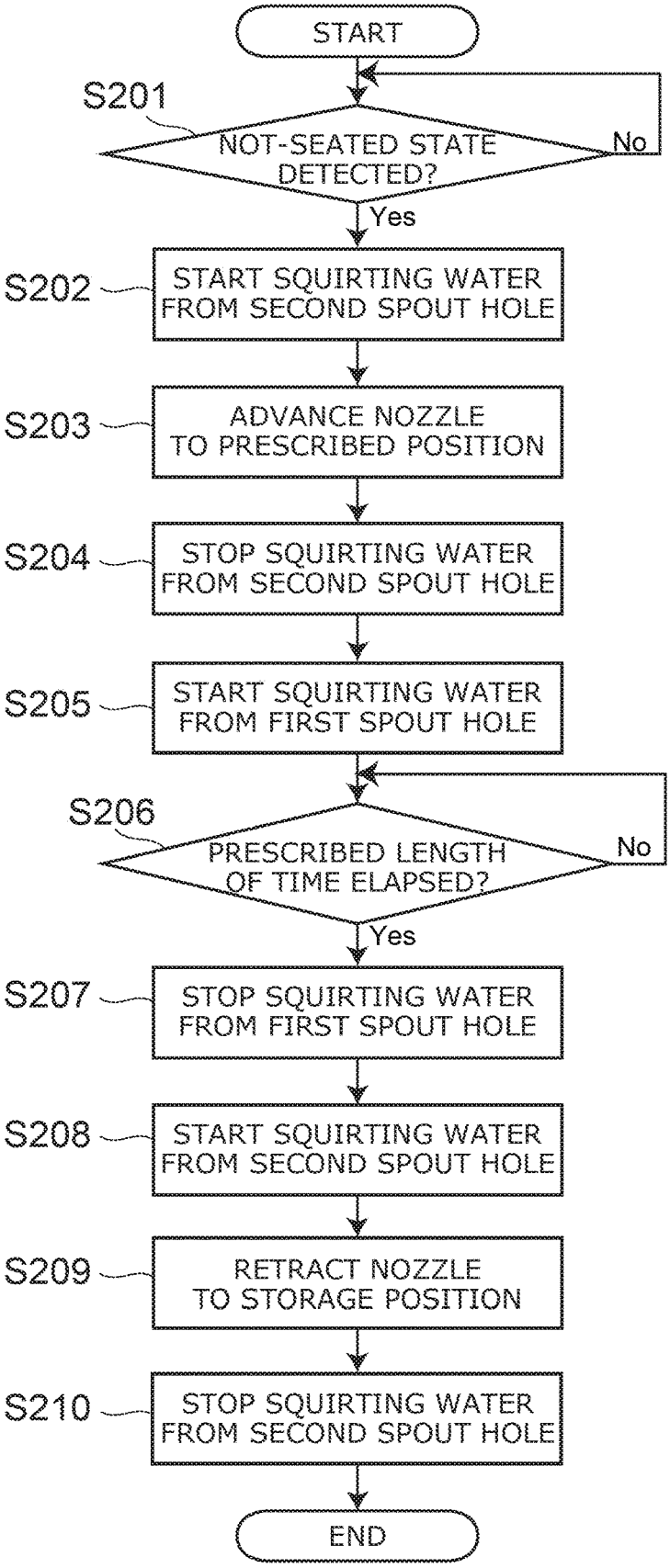
FIG. 10 is a flowchart illustrating another example of the operation of the sanitary washing device according to the embodiment.

FIG. 10 is a flowchart illustrating another example of the operation of the sanitary washing device according to the embodiment.

An example will now be described with reference to FIG. 10 for the flow when the squirting of the water from the first spout hole 479*a* (the frontward washing operation) and the squirting of the water from the second spout hole 479*b* (the backward washing operation) are performed in the post-use washing.

In the example as illustrated in FIG. 10, when the seating detection sensor 404 changes from the state of the seated state being detected to the state of the seated state not being detected (step S201: Yes), the controller 405 starts squirting water from the second spout hole 479*b* (the backward washing operation) (step S202).

When the squirting of the water from the second spout hole 479*b* is started, the controller 405 advances the nozzle 473 to the prescribed position in the state in which water is squirted from the second spout hole 479*b* (step S203). Thereby, the shielding plate 600 can be in the state of being rotated from the initial position to the second position. In other words, the controller 405 performs the backward washing operation of squirting water from the second spout hole 479*b* while rotating the shielding plate 600 from the initial position to the second position.

Thus, by performing the backward washing operation while rotating the shielding plate 600 from the initial position to the second position, water can be caused to adhere to a wider area of the bowl 801 in a shorter period of time.

When the nozzle 473 is advanced to the prescribed position, the controller 405 stops squirting water from the second spout hole 479*b* (the backward washing operation) (step S204) and starts squirting water from the first spout hole 479*a* (the frontward washing operation) (step S205).

After squirting water from the first spout hole 479*a* for a prescribed period of time (e.g., 6 seconds) (step S206: Yes), the controller 405 stops squirting water from the first spout hole 479*a* (the frontward washing operation) (step S207) and starts squirting water from the second spout hole 479*b* (the backward washing operation) (step S208).

When the squirting of the water from the second spout hole 479*b* is started, the controller 405 retracts the nozzle 473 to the storage position in the state in which water is squirted from the second spout hole 479*b* (step S209).

When the nozzle 473 is retracted to the storage position, the controller 405 stops squirting water from the second spout hole 479*b* (the backward washing operation) (step S210).

Step S202 may be performed after starting step S203 and before step S203 is completed. In other words, the controller 405 may start squirting water from the second spout hole 479*b* while advancing the nozzle 473.

Step S204 and step S205 may be performed after starting step S203 and before step S203 is completed. In other words, the controller 405 may stop squirting water from the second spout hole 479*b* while advancing the nozzle 473, and may start squirting water from the first spout hole 479*a* while advancing the nozzle 473.

Step S210 may be performed after starting step S209 and before step S209 is completed. In other words, the controller 405 may stop squirting water from the second spout hole 479*b* while retracting the nozzle 473.

Step S207 and step S208 may be performed after starting step S209 and before step S209 is completed. In other words, the controller 405 may stop squirting water from the first spout hole 479*a* while retracting the nozzle 473, and may start squirting water from the second spout hole 479*b* while advancing the nozzle 473.

Step S202 and step S204 are performed as necessary and are omissible. In other words, the backward washing operation that is performed before the frontward washing operation is performed as necessary and is omissible. Similarly, step S208 and step S210 are performed as necessary and are omissible. In other words, the backward washing operation that is performed after the frontward washing operation is performed as necessary and is omissible. In the embodiment, it is favorable for the backward washing operation to be performed at least before the frontward washing operation and after the frontward washing operation.

In the embodiment, the controller 405 may perform a pre-use washing before the sanitary washing device 100 is used. More specifically, for example, the controller 405 may perform the pre-use washing when the seating detection sensor 404 changes from the state of the seated state not being detected to the state of the seated state being detected.

The trigger of the pre-use washing is not limited to the user being seated. For example, the controller 405 may perform pre-use washing by using, as a trigger, the user entering the toilet room, a button operation to open the toilet lid 300, etc. The pre-use washing can be performed using a flow similar to the flows shown in FIG. 9 and FIG. 10 recited above.

In the sanitary washing device 100 in which the shielding plate 600 is provided frontward of a nozzle 473 according to the embodiments as described above, the sanitary washing device 100 can be provided in which water can be caused to adhere to the front side of the bowl 801 from the spout hole 479 provided in the nozzle 473.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. For example, the shape, the dimension, the material, the disposition, the installation feature or the like of the components included in the sanitary washing apparatus 100 are not limited to the illustration and can be appropriately modified.

The components included in the embodiments described above can be combined within the extent of technical feasibility, and any combined components also are included in the scope of the invention to the extent that the feature of the invention is included.

What is claimed is:

1. A sanitary washing device provided on a toilet including a bowl, the sanitary washing device comprising:

a casing;

a nozzle washing a human body private part, the nozzle being advanceable and retractable between a storage position and an advanced position, the nozzle being stored in the casing at the storage position, the nozzle being advanced from the casing at the advanced position;

a shielding plate provided rotatably with respect to the casing, the shielding plate being positioned frontward of the nozzle when the nozzle is at the storage position; and a controller controlling an operation of the nozzle, the nozzle having a first spout hole squirting water frontward and downward, the shielding plate being at an initial position when the nozzle is at the storage position, and being at a first position rotated a first angle from the initial position when the nozzle is at the advanced position, after a use of the sanitary washing device, the controller performing at least a frontward washing operation of squirting water from the first spout hole in a state in which the shielding plate is at a second position rotated a second angle from the initial position, the second angle being less than the first angle, at least a part of the shielding plate being positioned frontward of a front end part of the nozzle in the frontward washing operation.

2. The sanitary washing device according to claim 1, wherein the shielding plate is rotatable by advancing and retracting the nozzle, and the controller performs at least the frontward washing operation in the state in which the shielding plate is rotated from the initial position to the second position by advancing the nozzle from the storage position to a prescribed position between the storage position and the advanced position.

3. The sanitary washing device according to claim 1, wherein the second angle is less than an advance angle of the nozzle with respect to a vertical plane.

4. The sanitary washing device according to claim 1, wherein a lower end of the shielding plate when the shielding plate is at the second position is positioned lower than a center of the first spout hole or at a same height as the center of the first spout hole.

5. The sanitary washing device according to claim 1, wherein a squirt region of the first spout hole overlaps the shielding plate when the shielding plate is at the initial position, and does not overlap the shielding plate when the shielding plate is at the second position.

6. The sanitary washing device according to claim 1, further comprising:

a toilet seat; and a seating detection sensor detecting a seated state of a user on the toilet seat, the controller performing at least the frontward washing operation when the seating detection sensor changes from a state of the seated state being detected to a state of the seated state not being detected.

7. The sanitary washing device according to claim 1, wherein the nozzle further has a second spout hole squirting water backward of the first spout hole.

8. The sanitary washing device according to claim 7, wherein the controller performs at least a backward washing operation of squirting water from the second spout hole while rotating the shielding plate from the initial position to the second position.

9. The sanitary washing device according to claim 7, wherein the first spout hole and the second spout hole are positioned in the front end part of the nozzle, and the second spout hole is positioned sideward of the first spout hole.

* * * * *